United States Patent [19]

Schraut

[11] 4,160,575

[45] Jul. 10, 1979

[54] TELEPHONE CORD CONNECTOR

[75] Inventor: Eugene H. Schraut, Covina, Calif.

[73] Assignee: Vari-Tronics Co., Duarte, Calif.

[21] Appl. No.: 880,889

[22] Filed: Feb. 24, 1978

[51] Int. Cl.[2] ..... H01R 13/58

[52] U.S. Cl. ..... 339/103 M; 174/69; 339/99 R

[58] Field of Search ..... 174/69; 339/103 M, 103 R, 339/91 R, 99 R, 107, 176 MF, 217 R, 217 J, 217 S

[56] References Cited

U.S. PATENT DOCUMENTS

| | | | |
|---|---|---|---|
| 3,533,049 | 10/1970 | Thompson | 339/99 R |
| 3,835,445 | 9/1974 | Hardesty | 339/99 R |
| 3,860,316 | 1/1975 | Hardesty | 339/99 R X |

*Primary Examiner*—Roy Lake
*Assistant Examiner*—DeWalden W. Jones
*Attorney, Agent, or Firm*—Reed C. Lawlor

[57] ABSTRACT

A two-piece connector plug is provided for terminating a round electric cord of a modular telephone system. A retainer plug having two wedge-shaped legs is pressed through a lateral opening of the connector plug housing to compress and captivate the jacket of a round cord. This plug locks the cord firmly against rotational as well as pulling forces to which the cord may be subject.

20 Claims, 13 Drawing Figures

TELEPHONE CORD CONNECTOR

BACKGROUND OF THE INVENTION

1. Field of the Invention

This invention relates to an improvement in modular plugs for terminating a cord having a nonplanar array of conductors enclosed in a plastic jacket, that is, a jacket of substantially circular, or oval, peripheral shape. More particularly, the invention relates to improvements in plugs that are especially suited for terminating retractile telephone cords, especially round cords, to facilitate connection of such cords to modular jacks for use in modular telephone systems.

2. State-of-the-Art

For some time now, components of telephone systems have been marketed on a modular basis, so that telephone users may select various components at stores known as Phone-Center stores, or Phone Marts, and the suppliers of telephone systems, that is, the telephone companies themselves, have encouraged this by themselves providing modular components. More particularly, the telephone base that includes the dialing and ringing apparatus and the handset are supplied separately on a modular basis, and both the cord for connecting the telephone base to a wall terminal and the cord for interconnecting the telephone base with the telephone handset, are separately supplied and sold. The cords are supplied with modular plugs at each end which mate with jacks, or sockets, that are installed in the wall terminal, in the telephone base, and in the handset.

The cords themselves typically include a plurality of individually-insulated electrical conductors and a plastic insulating jacket in which they are enclosed. The cord that connects the telephone handset with the telephone base is generally of the retractile-type, such as the three-conductor round cord that is disclosed in Cox U.S. Pat. No. 2,609,417. In that round cord, as in many other round cords, the conductors are bunched together snugly. In four-conductor round cords commonly in use, the round cord is of oval configuration with major and minor axis of about 0.200 inch and 0.170 inch respectively, but in the coiled form are normally slightly flattened on the interior side of the coil.

More modernly, the conductors are arranged in a common plane in what is called a flat cord, such as described in Hardesty U.S. Pat. No. 4,002,392. But the terminals of jacks and plugs are often arranged in multiple planes or tiers. New installations generally involve such flat cords and such jacks and plugs. But where modular equipment is being supplied to replace old non-modular telephone apparatus, attempts are made to salvage the old round cords. This is done by cutting the ends and mounting modular plugs on them which are adapted to mate with modern modular jacks that are supplied for use with flat cords. Since there are over 100,000,000 non-modular telephones with round cords, the salvaging of these cords for use in modern modular telephone systems represents an important way to conserve natural resources, and the dollars of telephone users.

Modular plugs of the type that have been employed with flat cords are disclosed, for example, in Hardesty et al U.S. Pat. No. 3,761,869, Hardesty U.S. Pat. No. 3,860,316, Hardesty U.S. Pat. No. 3,998,514, and Hardesty U.S. Pat. No. 4,002,392. In all of those patents, a plug is provided that has a housing formed with a cavity in which a flat cord is enclosed with the conductors extending into cells where the conductors are electrically contacted by terminals. These terminals are arranged to make electrical connection with mating terminals of a jack.

In these plugs, an anchoring member pivotally mounted in a laterally extending side wall of the housing and pivoted to it, is pressed into anchoring engagement with the cord jacket. Attempts have been made to employ the same type of plug to clamp round cords in place in the plugs. Such an effort is represented by the Hardesty U.S. Pat. No. 4,054,350.

Experience has shown that when such plugs are used for terminating round cords, they are successful in satisfying specifications so far as longitudinal, or axial, forces are concerned. In other words, the plugs will withstand a 20-pound steady pull on the cord. But a large fraction of the round cords on which such modular plugs are mounted fail, when the cords are twisted. And such twisting often occurs during ordinary use of telephones on which such cords are used. To appreciate this problem, it will be recalled that the conductors are in the form of tinsel ribbons wound on insulating cores, such as linen or nylon thread. Cords made in this way are described, for example, in the aforementioned Cox et al patent. The terminals of the plugs are in the form of blades with points that pierce the insulating material on the individual conductors to make electrical contact with these tinsel wires or ribbons. The twisting of the conductors loosen or weaken the electrical contact between the conductors and these terminal blades. As a result, the electrical connections become subject to intermittent or permanent disconnection, rendering the telephone noisy or even completely useless.

It is an object of this invention to provide an improved modular plug especially suited for terminating cords that have generally circular configuration.

A further object of the invention is to provide an improved modular plug that is adapted to mate with jacks that are also adapted to mate with modular plugs used on flat cords.

It is a further object of the invention to provide a modular plug with improved means for resisting rotation and twisting of a round cord on which it is mounted.

It is a further object of the invention to provide an improved modular plug which can be more firmly secured to a telephone cord that it terminates.

SUMMARY OF THE INVENTION

A modular plug is provided for terminating a cord, especially used in telephone apparatus that includes modular components provided with jacks for connection to such plugs. The plug is particularly adapted for terminating a cord having a plurality of conductors disposed in a non-planar array within an insulating plastic jacket that has a round outer surface. The invention is particularly useful with cords having from 3 to 6 conductors bunched together and enclosed with a sliding fit within a round jacket.

The connector plug of this invention is very similar to those previously employed, and includes a housing composed of insulating material having a terminal end and a cord-input end. The cord-input end opens to a cavity that communicates through conductor passages with a plurality of conductor-receiving cells which are ordinarily arranged in two or more tiers, as in modular plugs of the type now commonly used with flat cords.

In such plugs, plate terminals of spade configuration extend through narrow slots into associated cells to pierce the insulation of and make electrical engagement with the conductor therein. Preferably, the housing is made of one piece to avoid the necessity of sonic bonding and to avoid the consequent difficulties to which such bonding normally leads.

But that is where the main similarity to the prior art ends.

In the best embodiment of this invention, a special anchor member, in the form of a double-wedged retainer plug, extends into the cavity of the connector plug from a lateral opening in the wall of the housing to captivate the jacket and to compress it in place against the opposite wall of the housing. The anchor member is provided with a pair of wedge-shaped cross-members, or legs, having shoulders which lock the anchor member in place mechanically after the anchor member is inserted through the lateral opening. In this position, the cross members compress the jacket tightly against the opposite wall of the cavity and with a portion of the jacket captivated between the cross members. With this arrangement, the cord is restrained against rotation within the housing as well as against being pulled longitudinally out of the housing.

BRIEF DESCRIPTION OF THE DRAWINGS

Other objects and features of the present invention will be more readily understood from the following detailed description of preferred embodiments thereof when read in conjunction with the accompanying drawings in which.

DETAILED DESCRIPTION OF THE INVENTION

In this application, the phrase modular cord system is intended to describe a system of telephone equipment that includes the use of electric connector plugs that may be assembled on the ends of cords to permit telephone-company customers to connect the cords to the other components of modular telephone equipment and particularly to wall terminals, handsets, and telephone bases of such equipment. In the best embodiment of the invention specifically disclosed herein in detail, the cord comprises a plurality of insulated conductors disposed in a non-planar array and enclosed in a common insulating plastic jacket having an external substantially cylindrical configuration. A cord having such external configuration is referred to hereinafter as round to distinguish it from cords that are flat. Such a round cord may be somewhat flat on one side.

The invention is distinguished from the prior art largely in the use of a novel connector plug for terminating the cord, which connector plug utilizes a retainer plug having two wedge-shaped cross members in a housing for anchoring the cord to increase the resistance of the assembled cord and connector against longitudinal and rotational strain. The purpose of the invention is achieved largely by the fact that the cord is compressed beyond its elastic limit by the wedges thereby grooving it transversely in two locations along its length and changing its shape permanently from round to partially flattened configuration and by the further fact that part of the cord is captivated between the wedges and partly by the fact that the round cord is anchored within a cavity that has an aspect ratio considerably different from unity.

Figure 1:
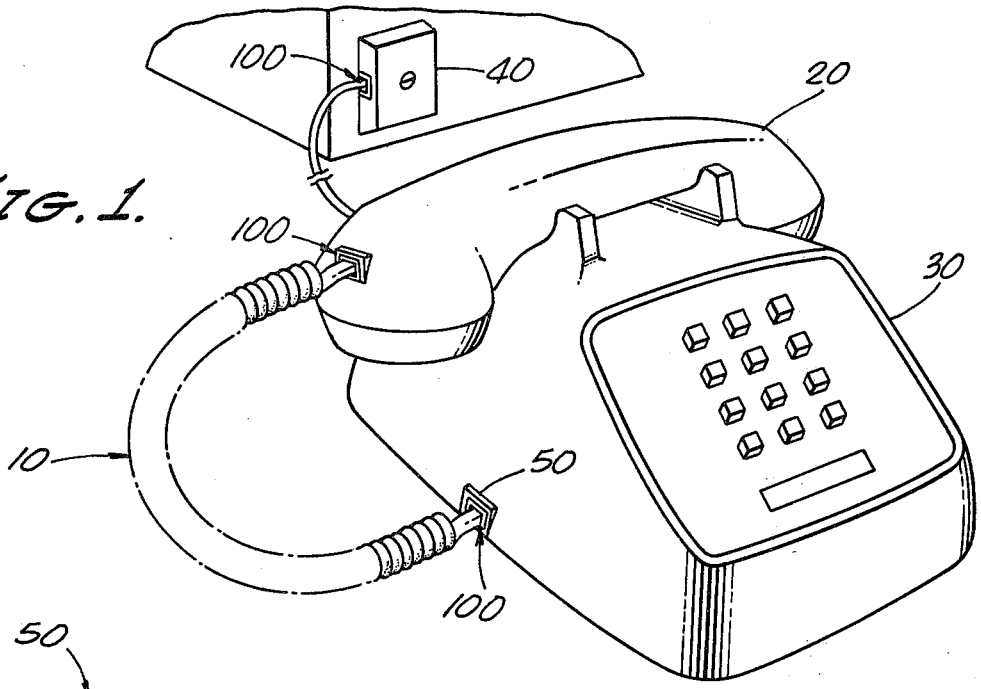
FIG. 1 is a perspective view of a telephone having a base and handset interconnected by a modular retractile cord which has been terminated with modular connector plugs, and showing the base connected to a wall terminal by a modular line cord which also has been terminated with modular plugs.
Figure 2:
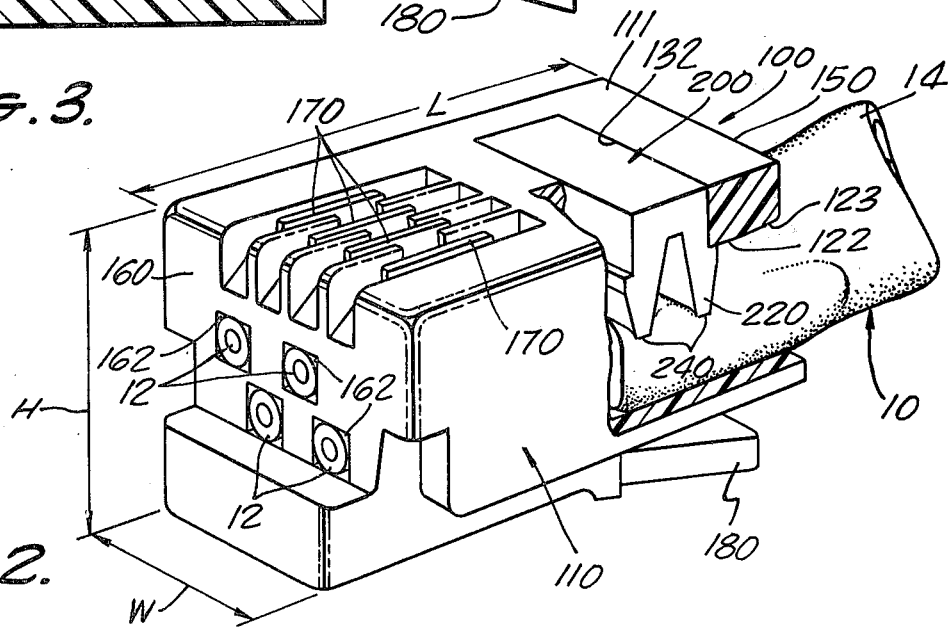
FIG. 2 is a perspective view of the plug partly broken away.
Figure 4:
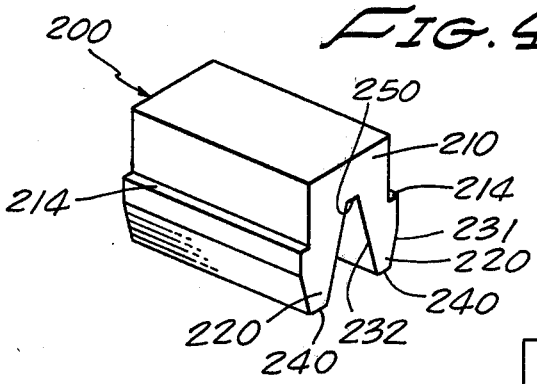
FIG. 4 is an isometric view of the cord anchor member, or retainer plug, as seen from above.

As indicated in FIGS. 1 and 2, the retractile cord 10 with connectors 100 assembled onto it at opposite ends thereof is connected from a telephone handset 20 to a base 30 by inserting each plug 100 into a jack 50 (see also FIG. 3) mounted therein. A non-retractile line cord 12 with such connectors at its ends may be connected from the base 30 to a wall terminal 40. This cord is also round. The jack 50, which is of conventional construction, is typically that shown in the above identified U.S. Pat. No. 3,860,316.

As previously mentioned, retractile cords of the general type to which the invention is applicable, are described in Cox et al U.S. Pat. No. 2,609,417. Such a cord includes a plurality of insulated conductors 12 enclosed in a jacket 14. Each of the conductors 12 comprises its own tubular insulation surrounding a plurality of tinsel ribbons, each wrapped helically about a filamentary core in the form of a nylon thread. When a straight cord with a circular cross-section is coiled to render it retractile, it becomes oval in cross-section and almost flat on the inner side thereof, as indicated in FIG. 3A. But it is still considered round, especially since the parts thereof at its ends may remain nearly circular in outline until anchored in a connector.

Figure 3:
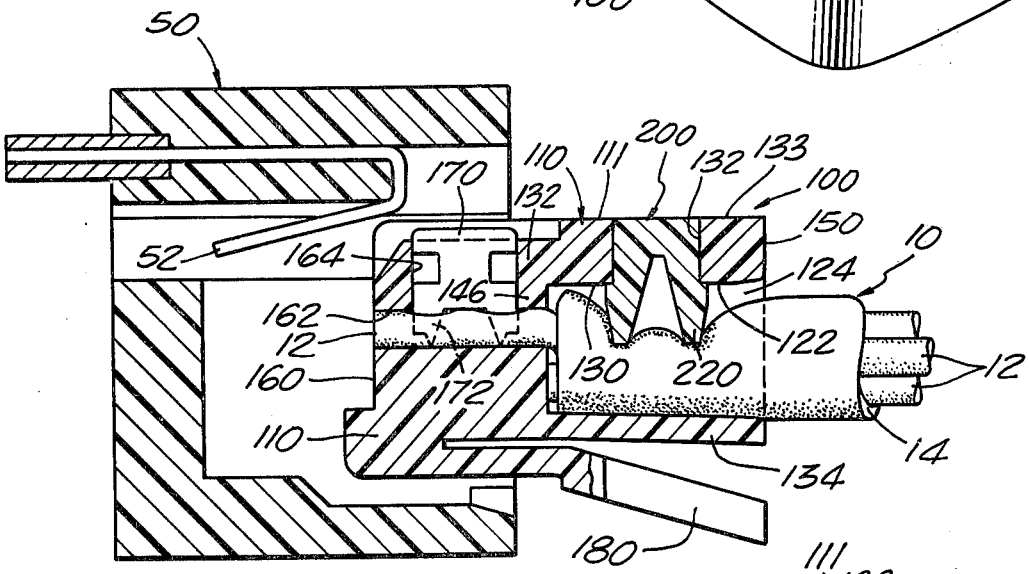
FIG. 3 is a sectional view showing a modular connector plug that embodies this invention, about to be inserted into a jack to connect the cord having conductors arranged in a non-planar array with corresponding conductors in the jack.
Figure 3A:
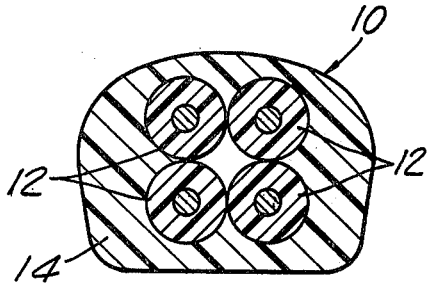
FIG. 3A is a cross-sectional view of a common four-conductor round cord.
Figure 5:
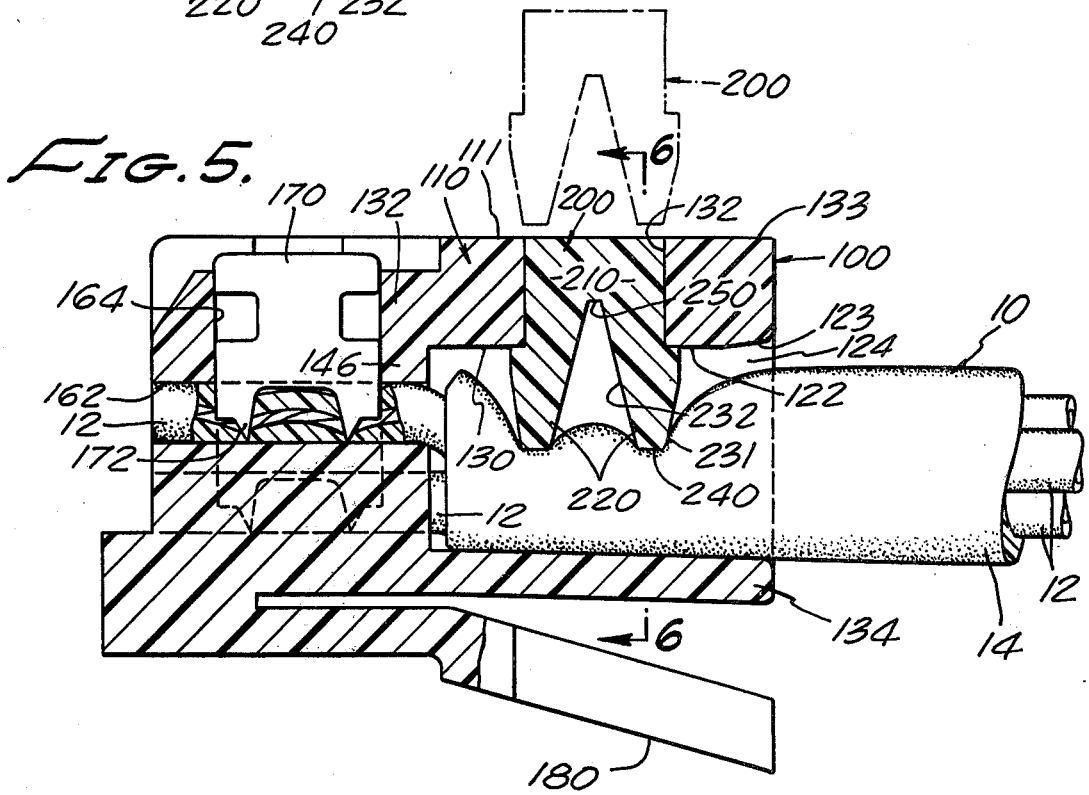
FIG. 5 is a sectional longitudinal view of the plug embodying this invention showing generally how the locking member squeezes and grabs the multiple conductor cord to shape it to resist rotation thereof within the plug.

As indicated in detail in FIGS. 2, 3, and 5, the modular connector plug 100 that embodies this invention includes a housing 110 which is made from insulating, that is, dielectric, material and a plurality of terminals 170. When the connector plug 100 is inserted into a jack 50, these terminals 120 make electric contact with the contact elements 52 of the jack 50.

The terminals 120 provide the electrical connection between the conductors 12 of the cord end that is anchored within the connector plug 100 and various electrical components in the telephone apparatus through the wire-like contact members 52 of the jacks 50.

The housing is provided with a locking lever 180 on the bottom side thereof, which is employed in a conventional manner to lock the connector plug in place in a jack and to permit voluntary, or deliberate, detachment of the plug 100 from the jack 50.

In addition to the housing 110, the modular plug 100 of this invention includes a separate cord anchor member, or retainer plug, 200 that projects through a lateral aperture 132 in the upper wall 111 thereof to lock the cord in place within the connector plug 100 and to anchor the cord against both longitudinal and rotational movement relative to the housing 110.

The connector plug 100 of this invention is very similar to those heretofore employed, as described in the Hardesty patents mentioned above, and particularly that described in the Hardesty U.S. Pat. No. 4,054,350. But it differs from those prior plugs in that it has no hinged clamping device at the inner end of the aperture and the retainer plug employs two, or possibly more, cross members for captivating the cord to achieve a firm anchoring action.

As in the best prior art devices, the connector plug housing 110 is a unipartite rigid housing (see FIGS. 2, 3, and 5), which is designed to be constructed from a thermosetting plastic material by use of conventional injection molding techniques. The plastic material must provide suitable mechanical strength as well as adequate electrical insulation and may be comprised, for example, of a polycarbonate, a polyester, a polyamide, or related terpolymer materials, such as ABS (acrylonitrile, butadiene, and styrene) resins. A polycarbonate commonly used for this purpose is sold by the General Eelectric Company under the trademark LEXAN. The housing 110 has a cord-input end 150 and a terminal end 160.

The jacket 14 of the cord 10 is composed of an elastomer material, such as neoprene (polychloroprene) or polyvinyl chloride. Thus, the housing is far more rigid than the conductor jacket.

As may be observed from FIGS. 2, 3, and 5, the cord-input end 150 of the housing 110 is formed with a cord-input aperture 122 which is designed to circumscribe generally the outer periphery of the largest cord 10 expected to be terminated with the connector plug 100. The unipartite housing 110 is constructed in one piece with no hinging, or bonding, of subparts required with the aperture 122 formed entirely therewithin. The aperture 122 has a slightly flared entrance 123 which prevents, advantageously, sharp bends in the cord 10 during customer use. The flared entrance 123 aslo facilitates insertion of an end portion of the cord 10 after the conductors 12 have been inserted. The cavity has an aspect ratio of about 1.5 and the flared entrance 123 is substantially rectangular cross-section and they are joined by an aperture neck having smooth walls that define an aperture 122 of gradually changing aspect ratio to facilitate squeezing the round cord into the rectangular cavity. Of course, the cavity and entrance may have rounded corners. Commonly there is a slight gap 124 between the upper part of the cord and the upper side of the flared entrance 123. The width of this gap, if there is one, depends on the original diameter of the cord.

The cavity 130 terminates adjacent a transition section 132 between the cord-input end 150 and the terminal end 160.

The cavity 130 and the cord aperture are formed in part by top and bottom walls 133 and 134 and front and rear side walls 135 and 136. Of course, the terms top and bottom and front and rear are purely relative and refer only to the manner in which the parts are represented in the drawings and to the manner in which the parts may be arranged for viewing. The transition section 132 includes a transverse wall 146 to connect the cavity 130 to the terminal end 160 of the connector plug 100.

As is conventional, the terminal portion 160 of the housing 110 is constructed to provide a plurality of individual compartments, or cells, 162 respectively (see FIG. 3), for receiving the conductors 12 of the cord 10. The cells are of sufficient size to accept the largest cross-sectional size conductor 12 expected to be encountered. Since the conductor cross-section is generally slightly smaller than the cross-section of the cell, an assembler can easily insert the conductors into the cells even though the conductors are very flexible.

As in prior devices, the cells 162 are arrranged in two tiers and are accessed from the upper side of the housing through slots 164 through which terminal plates 170 having spade points 172 project and pierce the insulation on the conductors to make electrical contact therewith.

The connector plug of this invention is very small. Its length L, width W, and height H are approximately 0.500 inch, 0.300 inch, and 0.325 inch respectively. The thickness of the upper apertured wall 133 through which the anchoring member 200 is inserted, is about 0.090 inch and the thickness of the opposite wall 124 is about 0.030 inch.

Though the elastomer is flowable and tends to return to its original shape slowly after being deformed, it is also characterized by an elastic limit. If compressed beyond that limit, the jacket is deformed, or reshaped, permanently. The cavity 130 for receiving the cord 10 into the housing 100 is of non-square rectangular configuration with a high aspect ratio in order to reshape the end of a round cord into a somewhat flat configuration. The cross section of the cavity about its longitudinal axis of 0.155 inch by 0.225 inch and is thus of a shape and size to readily accept a round cord of the dimensions set forth above. The length of the cavity, that is, the distance of the cavity into which the jacket may be inserted, is 0.250 inch.

The anchor member 200 may be composed of the same kind of material as the housing. Thus, the retainer plug 200 is relatively hard and the cord is relatively soft.

The aperture 132 through which the anchor member 200 is inserted to lock the cord in place, is also of non-square rectangular cross section, extending 0.120 inch longitudinally of the housing and 0.220 inch transversely thereof, but may be square. The upper wall 133 is provided with internal ledges or shoulders adjacent the aperture and on the cavity side of that wall.

The anchor member 200 is of rectangular horizontal configuration, being formed in part by an upper rectangular body section 210 that just fits slidably, but snugly, within the aperture 132 and a pair of resilient legs 220 in the form of wedges that are provided with external shoulders 214 at their junction with the body section 210. The shoulders 214 engage the ledges of the aperture 132 so that the anchor member is locked in place in the housing and anchors the cord in the housing 110 after the connector plug 100 has been assembled on the cord 10.

The aperture extends the full width of the cavity and the anchor member 200, including both its body and its legs, extend the full width of the cavity and the aperture. The transverse length of the anchor member 200 in the direction extending from side wall 135 to side wall 136 is about 0.004 inch less than the distance between the side walls. The maximum width of the body of the anchor member at the shoulders 214 exceeds the longitudinal dimension of the aperture to assure retention of the retainer plug 200 in assembled condition within the housing 100.

Each of the legs 220 is in the form of a wedge having an external surface 231 and internal surface 232 which taper toward its lower extremity or foot 240. The feet 240 of the legs are flat on the bottom. The feet are slightly rounded at their edges so as to greatly reduce the risk of cutting the jacket 14 of the cord. The inner surfaces of the legs converge to a crotch 250 near the center of the body. The plug thus has a reduced thickness at the shoulders 214 of the legs, rendering the plug flexible about the transverse axis of the body so that the anchor member may be readily pushed into the cavity and then locked in place with the cord 10 compressed between the feet and the opposite wall 134.

The retainer plug 200 is symmetrical about a transverse plane that is perpendicular to the longitudinal axis of the connector plug 100. The height of the retainer plug is 0.160 inch. The body portion has a height of 0.075 inch. The external shoulders have a width of 0.010 inch, and the portions of the legs that extend downwardly beyond the shoulders have a height of 0.085 inch. The widths of the feet at the bottoms of the wedge-shaped legs in a direction parallel to the longitudinal axis of the housing lies in the range from 0.018 inch to about 0.022 inch. And the corners of the feet are rounded, having a radius between about 0.001 inch to about 0.002 inch. The outer surfaces of the legs slope downwardly and inwardly by an angle between about 15° and about 17° and the angle between the two legs lies between about 15° and about 17° so that the crotch lies between about 0.020 inch to about 0.030 inch above the external shoulders of the retainer plug.

To facilitate the assembly of the connector plug 100 onto the cord, the distance between the outer surfaces of the legs at their feet is thus slightly less than the longitudinal dimension of the lateral aperture 132 in the housing.

In mounting a connector plug onto the end of a round cord 10, the cord is first stripped at that end to expose the insulated conductors 12. With the two parts of the connector plug separate, conductors are threaded through the passages 162 and into the cells and the cord is pressed into the cavity. In the stripping operation, the jacket is cut relatively straight at about a right angle relative to the axis of the conductors so as to present a flat surface to the interior or end wall 132 of the cavity. With a suitable tool or with the fingers, the cord is pushed and squeezed into the cavity as far as it will go. The blade-shaped terminals are then installed to make electrical contact with the conductors as taught, for example, in the Hardesty U.S. Pat. Nos. 3,860,316 and 4,054,350. A small gap between the end of the jacket 14 and the transverse wall 146 occurs because of the slight interference between the wall and the conductors in the transition area.

The anchor member 200 is then pressed through the aperture in the upper wall into captivating relation with the cord. In this operation, the outside surfaces of the legs are squeezed together and through the lateral aperture 132. Such squeezing is facilitated by the fact that the inner surfaces of the legs extend to the crotch near the center of the body, and by the fact that the outer surfaces slope outwardly from the feet in an upward direction. The resultant wedge shape of the legs permits the legs to flex inwardly and their feet to deflect inwardly toward each other until their shoulders pass the lower end of the lateral aperture. At that time, the legs spread outwardly so that the shoulders of the legs firmly engage the shoulders of the lateral aperture.

Figure 7:
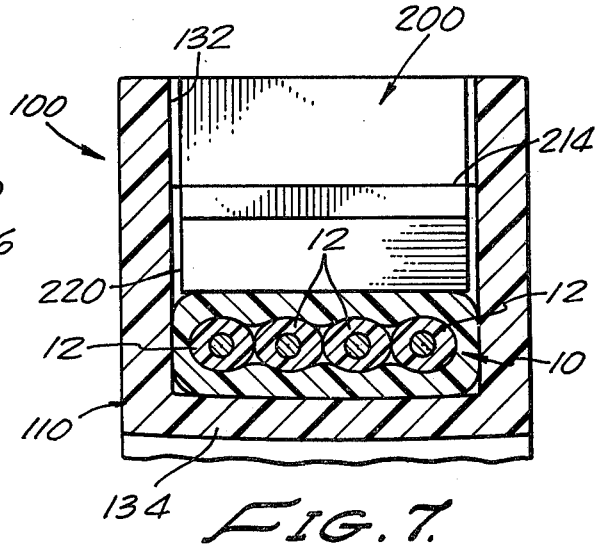
FIG. 7 is a sectional drawing of an embodiment of the invention applied to a flat cord.

In the assembly operation in which the anchor member is inserted into the housing, the feet of the anchor member engage the outer surface of the jacket and compress the cord almost 50%, thus reducing its thickness at the feet to about one-half the original diameter, or thickness, of the cord, as illustrated in FIGS. 5 and 7. The legs thus deform the cord, grabbing part of the cord between the legs so that that part of the cord becomes captivated and the thickness of the parts of the cord that are engaged by the feet are reduced a maximum amount. In the original condition of the cord 10, the conductors 12 are bunched together in mutual contact within the jacket as shown in FIG. 3A, but they have a sliding fit within the jacket and with respect to each other. But in the anchored part of the cord they are squeezed together tightly by the jacket, which itself is squeezed to substantially fill the cavity, at least in the space between the feet 220 and the lower wall 132. In this condition, the conductors are normally still in a non-planar array. The cord is actually compressed beyond its elastic limit so that if the connector plug is disassembled for inspection purposes, it is found that the cord does not resume its original shape but remains deformed to a large extent with two cross channels, or grooves, separated by the expanded captivated portion which has not been so deformed.

While a larger number of legs may be employed, two legs are best because they provide for maximum captivation of the jacket material for a given degree of jacket compression.

When the invention is applied to a flat cord of the type now commonly in use, the legs are somewhat longer and the deformation and captivation of the cord are similar to that described above, but the conductors are substantially coplanar, as indicated in FIG. 7.

Figure 8A:
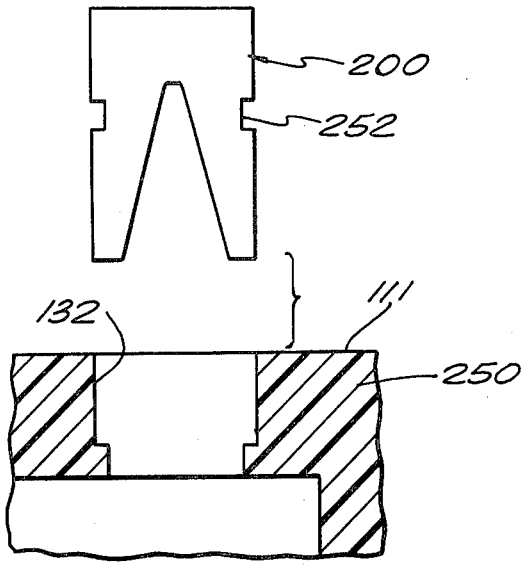
FIGS. 8A and 8B are elevational views of other forms of the anchor members.
Figure 8B:
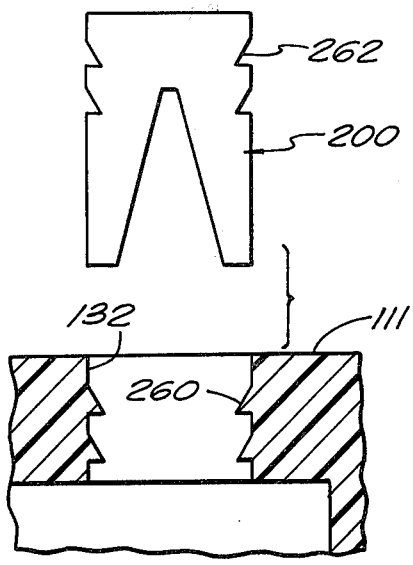

Though other means may be provided for locking the anchor member in place in the housing, the one described up to this point is believed to be the most secure. Other arrangements for locking the anchor member in place are illustrated in FIGS. 8A and 8B. In the arrangement represented in FIG. 8A, an inwardly projecting flange, or tongue, 250 on the walls of the aperture fit within transverse grooves 252 on the outer surface of the anchor members. This structure has the advantage of providing for greater flexing ability of the legs during the process of insertion of the anchor member into and through the lateral aperture. The arrangements of FIG. 8B employ tapered ledges, or serrations, 260 on the inner walls of the aperture and mating tapered grooves 262 in the body portion of the anchor member.

Figure 9A:
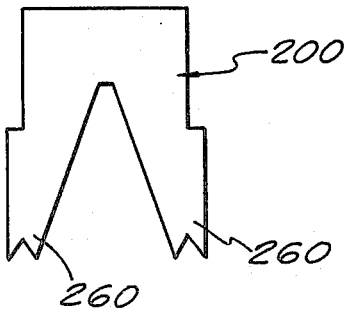
FIGS. 9A, 9B, and 9C are elevational views of still other forms of the anchor member.
Figure 9B:
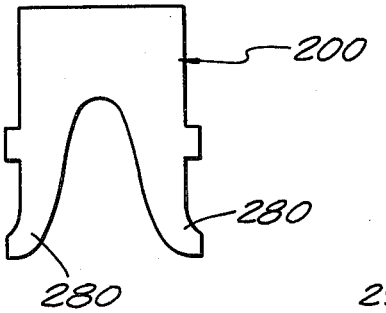
Figure 9C:
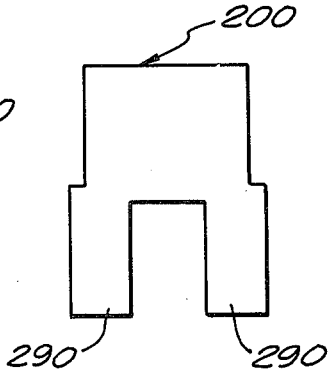

FIGS. 9A, 9B, and 9C illustrate anchor members 200 with other forms of legs.

All of the anchor members in these figures have legs that present a broad surface rather than a single sharp wedge arrangement at their feet, to reduce the risk of cutting the jacket 14. The anchor member of FIG. 9A with its grooved feet 270 with sharp projections, provides extra resistance to pulling forces but less resistance to rotating forces and is not as satisfactory as an anchor member with flat feet. The legs of the anchor members of FIGS. 9B and 9C are almost as effective as those illustrated in FIGS. 2, 3, 4, and 5, since they present blunt, relative flat surfaces 280 and 290 to the external surface of the jacket.

Figure 6:
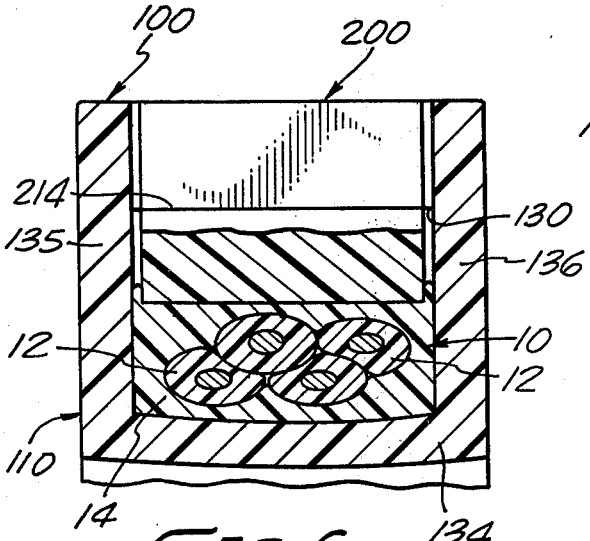
FIG. 6 is a sectional drawing taken on the plane 6—6 of FIG. 5.

In all cases, the length of the wedges transverse to the length of the housing, extends substantially the full length of the cavity, as indicated in FIGS. 3, 6, and 7, reducing the danger of tearing that might occur if the ends of wedges were sharp and terminated between the sides of the compressed cord. But some of the jacket is squeezed into the narrow spaces of about 0.002 inch between the anchor member 200 and the side walls 135 and 136.

For best effect, the surfaces of the feet are flat and free of protuberances across the width of the cavity and free of sharp corners. The flat blunt feet with rounded corners produce maximum reforming and captivation of the cord and hence provide for maximum resistance to rotation of the cord within the housing. The feed of the wedges may have small downwardly facing protuberances, or other irregularities, so long as sharp edges are avoided.

It is thus apparent that this invention provides modular terminal connector plugs for terminating modular cords of modular telephone systems in order to reduce the danger of failure of such systems because of forces applied between the cords and the plugs, either longitudinally or rotationally.

The invention claimed is:

1. In a modular connector for making electrical connections with a cord composed of a plurality of mutually-insulated conductors encased within a plastic insulating jacket and with another component external to the connector, which connector includes an insulating housing that has a cord-receiving cavity with an aperture at the cord end thereof and a plurality of conductor-receiving cells at the terminal end thereof and passages providing communication from said cavity to said cells and terminal receiving openings in association with the cells, whereby, when such a cord is inserted longitudinally into said cavity from said cord end, exposed ends of said conductors extend longitudinally through said apertures from said cavity toward said terminal end into said cells, and terminals may extend into said cells through said openings into electrical communication with said exposed ends, the improvement wherein said housing has a lateral opening through a side wall thereof in communication with said cavity and has an edge at said opening that extends transversely of said housing, said improvement also including a separate anchoring member that extends from said lateral opening into said cavity and which comprises a projecting part for engaging said edge to clamp said anchoring member against outward escape through said lateral opening, said anchoring member also comprising at least two spaced cross members that extend transversely of said housing on the cavity side thereof to compress said jacket to fit tightly against the wall of said cavity opposite said lateral opening and with a portion of said jacket captivated between said spaced cross members, whereby said cord is restrained both against being pulled longitudinally out of said housing and against axial rotation within said housing.

2. A modular cord connector as defined in claim 1, wherein said anchor member comprises a pair of separate legs extending downwardly from the upper body thereof and having said two cross members formed at the respective bottoms thereof.

3. A modular connector as defined in claim 2, wherein each of said legs has an external surface that slopes downwardly and inwardly toward the central axis of said body and an internal surface that slopes downwardly and inwardly from said central axis, said inner surfaces of said legs diverging away from a pivot axis that extends through said body transversely thereof on the opposite side of said projecting part from the side on which said cross members are located.

4. A modular connector as defined in claim 1, wherein said lateral opening has a second transversely extending edge at said opening and wherein said anchoring member comprises a second projecting part for engaging said second edge to clamp said anchoring member against outward escape through said lateral opening.

5. A modular connector as defined in claim 4, wherein each of said legs has an external surface that slopes downwardly and inwardly toward the central axis of said body and an internal surface that slopes downwardly and outwardly from said central axis, said inner surfaces of said legs diverging away from a pivot axis that extends through said body transversely thereof on the opposite side of said projecting parts from the side on which said cross members are located.

6. In a modular connector for making electrical connections with a cord composed of a plurality of mutually-insulated conductors encased within a plastic insulating jacket and with another component external to the connector, which connector includes an insulating housing that has a cord-receiving cavity with an aperture at the cord end thereof and a plurality of conductor receiving cells at the terminal end thereof and passages providing communication from said cavity to said cells, and terminal-receiving openings in association with the cells, whereby, when such a cord is inserted longitudinally into said cavity from said cord end, exposed ends of said conductors extend longitudinally through said apertures from said cavity toward said terminal end into said cells and terminals may extend into said cells through said openings into electrical communication with said exposed ends, the improvement wherein said housing has a lateral opening through a side wall thereof in communication with said cavity and has edges on opposite sides of said opening that extend transversely of said housing, said improvement also including a separate anchoring member that extends from said lateral opening into said cavity and which comprises a body with oversize shoulders on opposite sides thereof for engaging said edges after said anchoring member has been pressed into said aperture and said cavity to clamp said anchoring member against outward escape through said lateral opening, said anchoring member comprising two spaced apart legs that extend downwardly on the cavity side of said anchoring member to compress said jacket to fit tightly against the wall of said cavity opposite said lateral opening and with a portion of said jacket captivated between said spaced cross members, whereby said cord is restrained both against being pulled longitudinally out of said housing and against axial rotation within said housing.

7. A modular connector as defined in claim 6, wherein said two legs have blunt feet at the bottom ends thereof.

8. A modular connector as defined in claim 7, wherein each of said legs has an external surface that slopes downwardly and inwardly toward a central plane that extends transversely of said anchoring member and an internal surface that slopes downwardly and outwardly from said central axis, said inner surfaces of said legs diverging away from an axis that extends through said body transversely thereof.

9. A modular connector as defined in claim 8, wherein said axis lies on the opposite side of said shoulders from said feet.

10. In a modular cord system that has a modular cord composed of a plurality of mutually-insulated conductors encased within a plastic insulating jacket and a modular connector at one end of said cord for making electrical connections with a jack, which connector comprises an insulating housing that has a cord receiving end and a terminal end, and that has a cord-receiving cavity with a cord aperture at the cord end thereof and a plurality of conductor-receiving cells at the terminal end thereof and conductor-passing passages providing communications from said cavity to said cells, and that has terminal receiving openings in association with the cells; said housing having first and second laterally extending walls and two side walls that define said cavity and said cord aperture, and having a lateral opening in said first wall in communication with said cavity, said first wall having an edge at said opening, said cord extending longitudinally through said cord aperture into said cavity from said cord end with said conductors extending longitudinally from said cavity through said passages toward said terminal end; said connector being provided with terminals that extend into said cells through said openings into electrical contact with said exposed ends of said conductors;

the combination with said housing, said cord, and said terminals of a separate anchoring member that extends from said lateral opening into said cavity, said anchoring member having a shoulder in engagement with said edge to lock said anchoring member against outward escape through said lateral opening, said anchoring member also comprising two spaced cross members that extend transversely of said housing on the cavity side thereof to compress said jacket against the wall of said cavity opposite said lateral opening and with a portion of said jacket captivated between said space cross members;

whereby said cord is restrained both against being pulled longitudinally out of said housing and against axial rotation within said housing.

11. In a modular cord system as defined in claim 10, wherein said cord is originally of generally round cross section throughout its length when free, and in which said cord end is compressed by said anchor member to have an oblong cross section within said cavity.

12. In a modular cord system as defined in claim 10, in which the parts of said cord on opposite sides of the portion thereof that is compressed by said cross members are expanded laterally within said cavity into compression against the side walls thereof.

13. In a modular cord system that has a modular cord composed of a plurality of mutually-insulated conductors encased within a plastic insulating jacket and a modular connector at one end of said cord for making electrical connections with a jack, which said connector comprises an insulating dielectric housing that has a cord receiving end and a terminal end, and that has a cord-receiving cavity with a cord aperture at the cord end thereof and a plurality of conductor-receiving cells at the terminal end thereof and conductor-passing passages providing communications from said cavity to said cells, and that has terminal receiving openings in association with the cells; said housing having first and second laterally extending walls and two side walls that define said cavity and said cord aperture and having a lateral opening in said first wall in communication with said cavity, said first wall having transversely extending edges at said opening, said cord extending longitudinally through said cord aperture into said cavity from said cord end with said conductors extending longitudinally from said cavity through said passages toward said terminal end; said connector being provided with terminals that extend into said cells through said openings into electrical contact with said exposed ends of said conductors, the combination with said housing, said cord, and said terminals of a separate anchoring member that extends from said lateral opening into said cavity, said anchoring member having shoulders on opposite sides thereof in engagement with said edges to lock said anchoring member against outward escape through said lateral opening, said anchoring member also comprising two spaced apart legs that extend downwardly on the cavity side of said anchoring member to compress said jacket to fit tightly against at least the wall of said cavity opposite said lateral opening and with a portion of said jacket captivated between said space cross members, whereby said cord is restrained both against being pulled longitudinally out of said housing and against axial rotation within said housing.

14. In a modular cord system as defined in claim 13, wherein said two legs have blunt feet at the ends thereof that compress said cord.

15. In a modular cord system as defined in claim 14, wherein said cord is originally of generally round cross section throughout its length when free and in which said cord end is compressed by said feet to have an oblong cross section within said cavity.

16. In a modular cord system as defined in claim 14, in which the parts of said cord on opposite sides of the portion thereof that is compressed by said feet are expanded laterally within said cavity into compression against the side walls thereof.

17. In a modular cord system as defined in claim 13, wherein each of said legs has an external surface that slopes downwardly and inwardly toward a plane of symmetry that extends transversely through said body and an internal surface that slopes downwardly and outwardly from said plane, said inner surfaces of said legs diverging away from a pivot axis that extends through said body transversely thereof on the opposite side of said shoulders from said feet.

18. A modular cord connector as defined in claim 1 wherein said housing member is unipartite.

19. In a method of manufacturing a modular cord as defined in claim 10, from a cord of round external cross-section that involves the steps of selecting a two-part connector as described in claim 10, including a housing having a cord apertured cavity of smaller cross-section than said cord, stripping the jacket from the ends of said cord to expose ends of said conductors, threading the exposed ends through said passages into said cells forcing the cord into said cavity and forcing terminals through said terminal receiving openings to lock said conductors in place in said cells respectively and to establish electrical contact therewith, the improvement that comprises pressing said anchoring member through said lateral opening of said housing to force said cross members into pressure engagement with said jacket and to compress said jacket against the wall of said housing on the opposite side of the housing cavity from said lateral aperture and to compress the material of said jacket member beyond its elastic limit, and continuing the compressing until the anchoring member flexes into locking engagement with the edge of said lateral opening and said jacket has been captivated between said cross members.

20. In a method of manufacturing a modular cord as defined in claim 19, comprising the step of compressing the jacket material against said opposite wall to expand said jacket member into compressing relationship with the side walls of said cavity.

* * * * *